US005279467A

United States Patent [19]

Lydy

[11] Patent Number: 5,279,467

[45] Date of Patent: Jan. 18, 1994

[54] FLAIL ASSEMBLY FOR CHIPPER SHREDDER

[75] Inventor: Bruce S. Lydy, West Bend, Wis.

[73] Assignee: Garden Way Incorporated, Troy, N.Y.

[21] Appl. No.: 918,275

[22] Filed: Jul. 20, 1992

[51] Int. Cl.[5] ..... B02C 13/28

[52] U.S. Cl. ..... 241/101.7; 241/92

[58] Field of Search ..... 241/92, 101.7, 194, 241/195

[56] References Cited

U.S. PATENT DOCUMENTS 3,482,788 12/1969 Newell ..... 241/194 X 4,834,302 5/1989 Baker ..... 241/92

*Primary Examiner*—Douglas D. Watts

*Attorney, Agent, or Firm*—Hayes & Reinsmith

[57] ABSTRACT

A chipper/shredder having rotatably driven shredding mechanism including a frame rotatable about a central axis, which frame has a plurality of axially spaced disc-shaped supports mounted thereon for rotation therewith and a plurality of carriers extending between and secured to the supports at a radius from the axis of rotation with each carrier pivotally supporting a plurality of flails wherein the axial spacing between the flails is such that each flail on each carrier has a tip end which traces a path that is axially offset from the path of each other flail tip end.

2 Claims, 5 Drawing Sheets

FLAIL ASSEMBLY FOR CHIPPER SHREDDER

FIELD OF THE INVENTION

The present invention generally relates to apparatus for chipping and/or shredding of branches, limbs, twigs and the like to effect material size reduction and is more particularly directed to such a chipper/shredder using swinging flails or hammers mounted on a rotatable carriage and to the provision of an improved flail structure for such apparatus.

BACKGROUND OF THE INVENTION

Illustrative of prior art relating to the present invention, is U.S. Pat. No. 4,834,302 issued May 30, 1989, which patent discloses the general construction and operation of gasoline engine driven chipper/shredders including the use of flails or hammers pivotally mounted on a driven carrier to shred or otherwise comminute material fed through the inlet hopper of the apparatus. FIGS. 5 and 12 of U.S. Pat. No. 4,834,302 are of interest as being illustrative of known prior art, flail or hammer structures. Such prior art structures have been known to be a cause for reduced through-put of material to be shredded and were found to be generally expensive to manufacture and assemble.

SUMMARY OF THE INVENTION

It is therefore a principal object of this invention to provide a chipper/shredder having an improved flail or hammer assembly that reduces manufacturing and assembly costs for the shredder while improving the shredding action.

It is a further object of this invention to provide a chipper/shredder having an improved flail structure that enhances the rate at which material can be shredded thereby resulting in an increased through-put for the shredder with a reduced opportunity for material clogging in the chipper/shredder.

It is another object of this invention to provide an improved flail mounting arrangement construction that improves the ease of manufacture and tolerance control while reducing the cost of assembling and using the components thereof.

It is yet another object of this invention to reduce the assembled mass of the flail or hammer structure that is rotated to thereby reduce the loads placed upon the engine and drive assembly while improving the overall performance of the shredding action.

It is still a further object of this invention to provide a shredder having a flail or shredder assembly having fewer pivoted flails or hammers than in the prior art structures while, at the same time, increasing the number of cutting surfaces presented to the material to be shredded with fewer blades than shredder assemblies of the prior art.

It is an additional object of the present invention to provide a simplified carriage assembly for the rotatable shredding apparatus that reduces the number of flail supports of the prior art and reduces the number of flails while at the same time increasing the number of operative cutting surfaces presented by the flails to the material to be comminuted.

A still further object of the invention is to provide a chipper/shredder having an improved shredding apparatus including free swinging pivotally mounted blades mounted on a reduced number of carriers extending between and secured to supports for rotation about a central axis with the flails being arranged such that each flail tip traces a path that is axially offset from the path traced by each other flail tip.

In the preferred embodiment, the foregoing objects are obtained by providing a chipper/shredder having rotatably driven shredding mechanism including a frame rotatable about a central axis, which frame has a plurality of axially spaced disc-shaped supports mounted thereon for rotation therewith and a plurality of carriers extending between and secured to the supports at a radius from the axis of rotation with each carrier pivotally supporting a plurality of flails wherein the axial spacing between the flails is such that each flail on each carrier has a tip end which traces a path that is axially offset from the path of each other flail tip end.

DESCRIPTION OF A PREFERRED EMBODIMENT

Figure 1:
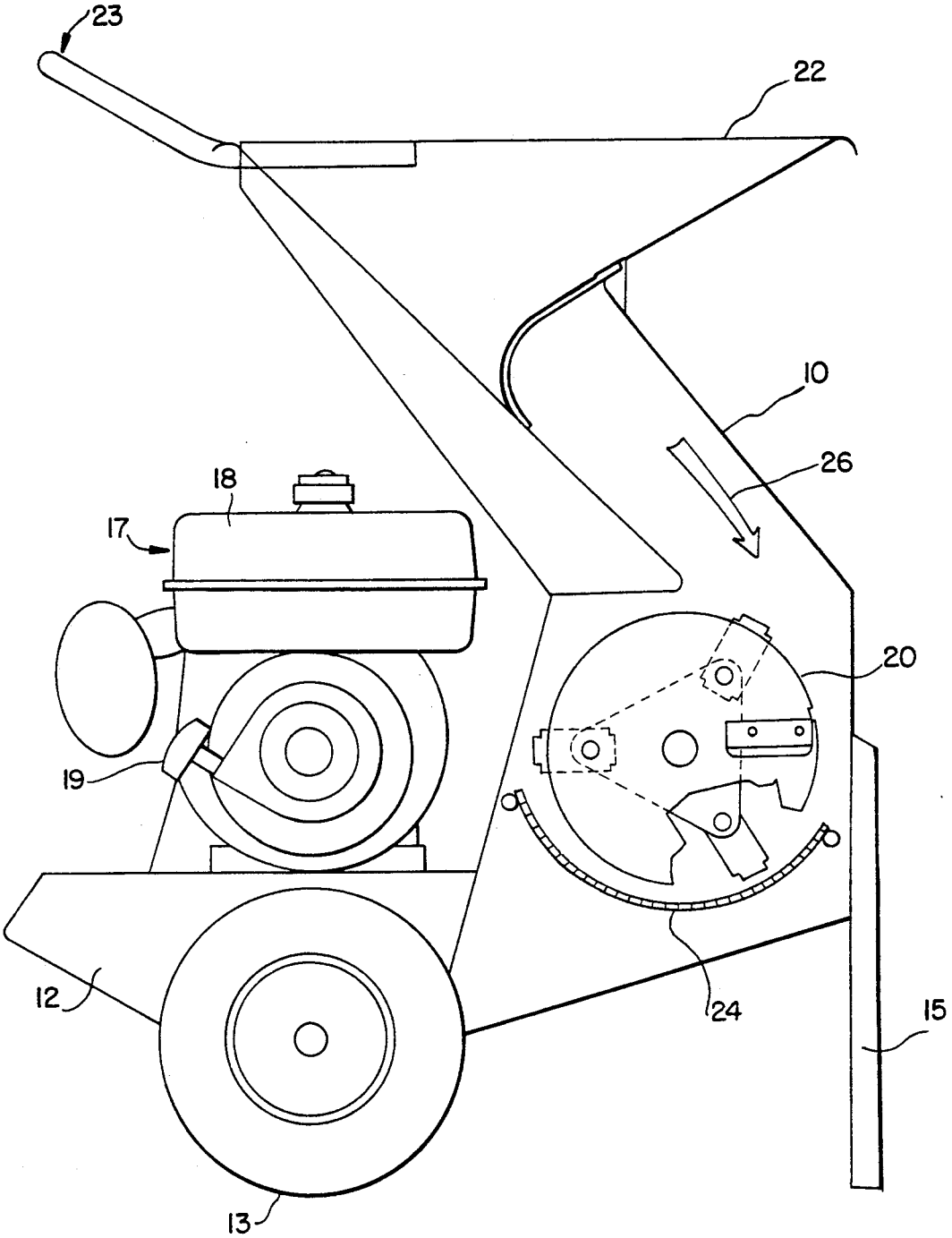
FIG. 1 is a schematic view of the side elevation of a typical chipper/shredder using the features of the present invention.

Turning first to FIG. 1, a chipper/shredder is shown in a schematic drawing with a portion of the housing structure removed to reveal certain internal parts including the flail assembly. The chipper/shredder apparatus generally designated 10 is shown as including a frame 12 supported on wheels 13 (only of which is shown) for transportation to the desired location, the wheels cooperating with leg 15 to support the apparatus for use. A gasoline engine generally designated 17 includes the customary fuel tank 18 and a starter mechanism 19 supported on frame 12 and suitably connected to drive the flail assembly generally designated 20. An inlet chute 22 forms part of the framework and a suitable handle 23 is provided to assist in moving the apparatus from place to place. There is of course a side panel for the apparatus which is not shown and which would serve to enclose the assembly 20. A customary outlet screen 24 is suitably supported within the apparatus and the assembly 20 rotates as hereinafter described in greater detail so that materials fed into hopper 22 in the direction of arrow 26 will be engaged by rotating flail assembly 20 so as to be reduced in size before passing through the screen assembly 24 to be deposited on the exterior of the apparatus for use as garden mulch etc. The apparatus shown in FIG. 1 has the same general functional purpose as that shown in the aforementioned U.S. Pat. No. 4,834,302 but with an improved flail assembly 20.

Figure 2:
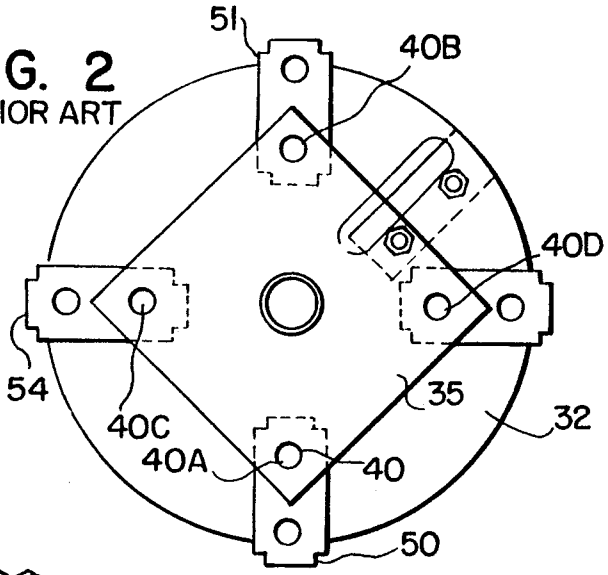
FIG. 2 PRIOR ART
FIG. 2 is a side elevational view of the prior art.
Figure 3:
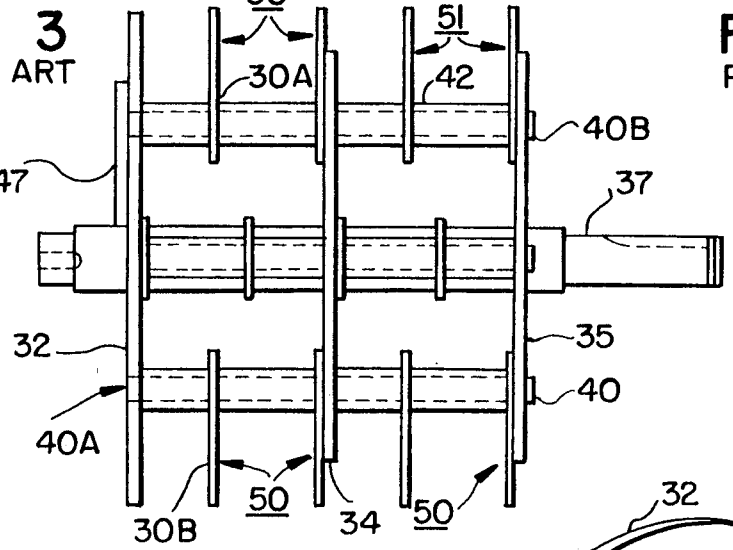
FIG. 3 PRIOR ART
FIG. 3 is a top plan view of the prior art shown in FIG. 2.
Figure 4:
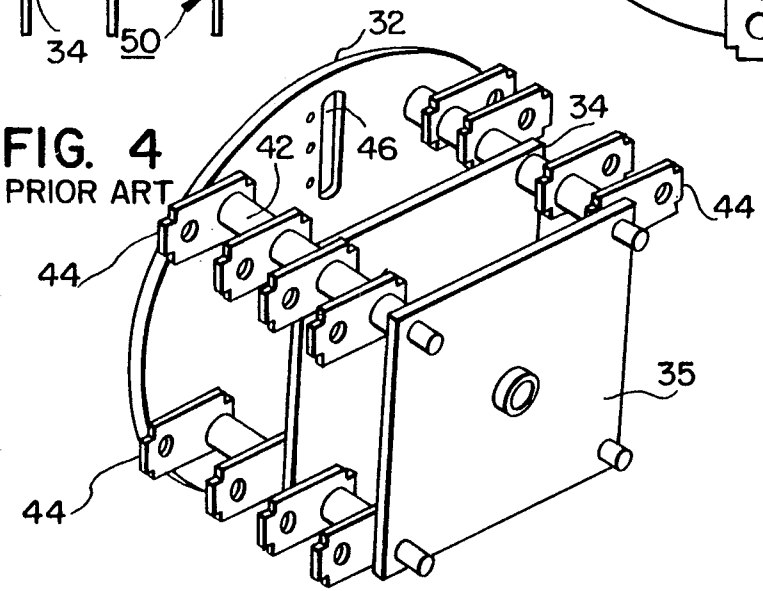
FIG. 4 PRIOR ART
FIG. 4 is a partial perspective view of the flail assembly of the prior art of FIGS. 2 and 3.

Before undertaking to describe the specific features of the present invention, attention is directed to FIGS. 2, 3 and 4, drawings of prior art showing a more or less conventional flail assembly of the prior art, such flail assembly being a number of free swinging blades or shredding members. There are four such sets of flails 30 (shown most clearly in FIGS. 2 and 3) supported between the chipper disc 32 and the intermediate support plates 34 and 35, disc 32 and plates 34 and 35 being supported on a central shaft 37 which is driven by a suitable gasoline engine. Flails 30 are arranged in four sets, each set mounted on its own shaft 40 positioned for convenience at the corner of the square end intermediate support plates 34 and 35. Flails 30 are separated by suitable spacing collars 42 which maintain the relative orientation of the flails on the respective shafts while permitting them to swing (perferably) so that ends 44 of each flail can engage the material to be shredded. For convenience it is noted that a chipper opening 46 and a blade 47 are provided on disc 32 but such an arrangement is not part of the present flail assembly except that it is carried by the end disc 32.

As best seen in FIG. 3, flail group 50 is supported on shaft 40A and flail group 51 are supported on shaft 40B. Collars 42 serve to position each flail set along its respective shaft and as noted in FIGS. 2 and 4, a second set of flail groups 53 and 54 are respectively supported on shafts 40C and 40D with similar collars arranged to determine the positioning of the flails on their respective shafts. As best seen in FIG. 3, the flails of group 51 are in circumferential alignment with the flail of group 50 such that, upon rotation, flail 30A, for example, traces the same circumferential path as flail 30B. With such a four-pin flail arrangement, we have in effect two sets of flail blades which are located opposite each other and "racked" identically so as to produce a dynamically balanced assembly.

Figure 6:
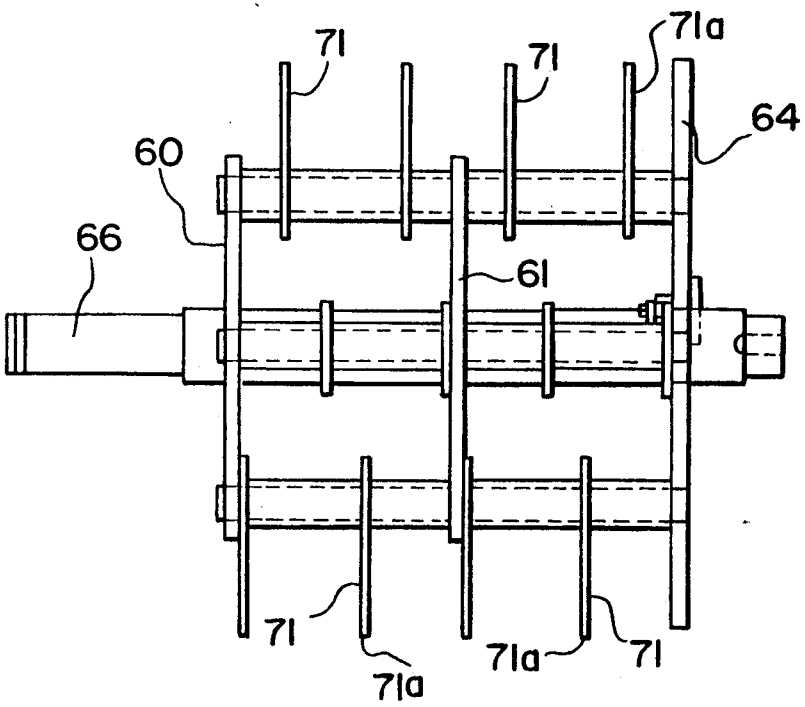
FIG. 6 is a top elevational view of a preferred embodiment of the flail assembly of the present invention.
Figure 5:
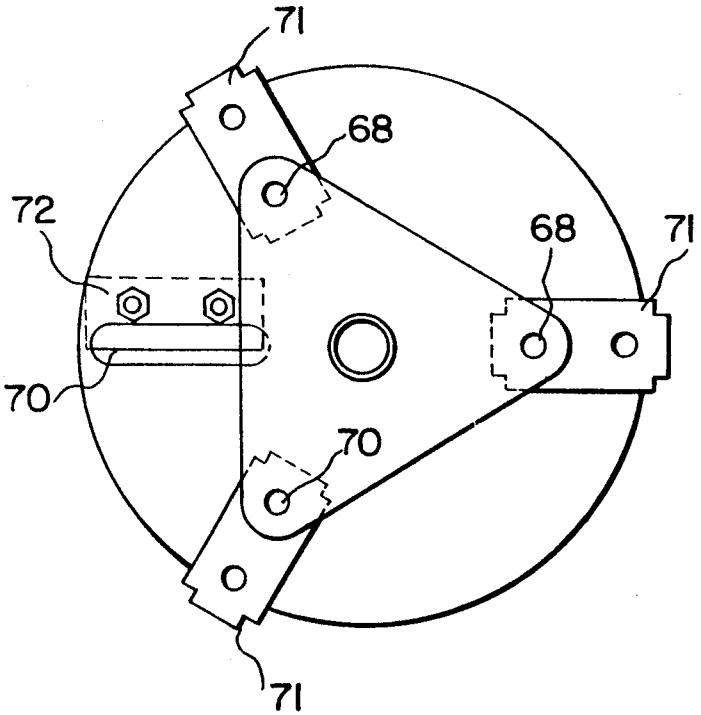
FIG. 5 is a side elevational view of a preferred embodiment of the flail assembly of the present invention.
Figure 7:
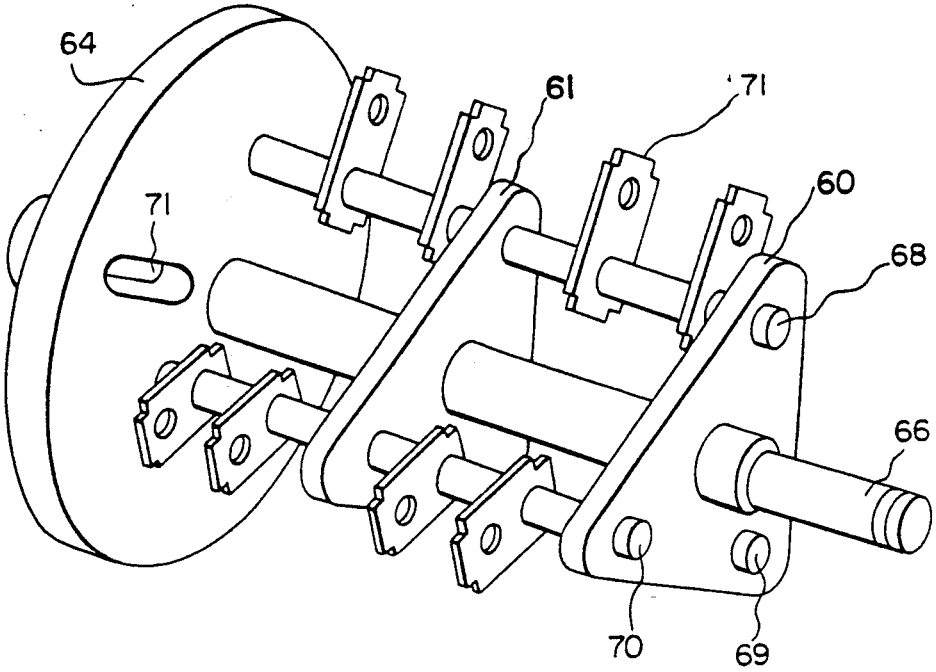
FIG. 7 is a perspective of the flail assembly of the present invention.

Turning next to FIGS. 5, 6 and 7 which disclose the flail assembly of the present invention (which assembly is schematically illustrated in FIG. 1), it is seen that advantage is taken by the present invention of the fact that a plane surface is determined by three points and hence, it is easier to define plates 60 and 61 as triangularly shaped plate members which are positioned generally parallel to disc 64 with the entire assembly being supported on a shaft 66 for driving connection to a suitable gasoline engine. The carrier members or shafts 68, 69 and 70 are supported near the apex of the triangular support plates 60 and 61 and are of course are secured to disc 64. As with the previously discussed prior art, a suitable slot 71 and a blade 72 are provided on disc 64 for chipping action, which action is not part of the present invention. Each carrier 68, 69 and 70 supports a plurality of flails 71 for pivotal action (preferably) with the spacing of each flail on each carrier member being determined by collars 90 as best seen in the exploded view of FIG. 8. A primary feature of the present invention is seen in FIG. 6 where the tip end 71*a* of each flail is so mounted and positioned on the carriers as to trace a generally circular path that is different from and offset from the tip end path traced by each other flail.

With such an arrangement, it is believed quite clear that the 16 flails shown in prior art FIGS. 2, 3 and 4 actually function (when analyzing the cutting action), as two sets of flail blades rather than four, for the reason that half of the flails are in line with the other half of the flails thereby effectively reducing the number of cutting surfaces.

On the other hand, the flail assembly of FIGS. 5, 6, 7 and 8 reduces the number of carriers (69, 70 and 71) while maintaining the same number of flails on each carrier thereby producing one-third fewer flails while in fact increasing the number of tip end cutting surfaces available from the total number of shredder blades or flails; in effect, the concentric and coplanar cutting action of the four-blade flail arrangement of the prior art is eliminated. The arrangement of the present invention clearly reduces the mass of the rotating flail assembly and carriage of the prior art while increasing the number of cutting surfaces presented to the leaves, etc. to be shredded such as to provide for faster shredding of the material and greater through-put with the shredder. In effect, the four-pin arrangement of FIGS. 2, 3 and 4 produces a total eight effective cutting edges whereas the three-pin arrangement of the present invention produces a total twelve such surfaces.

Figure 8:
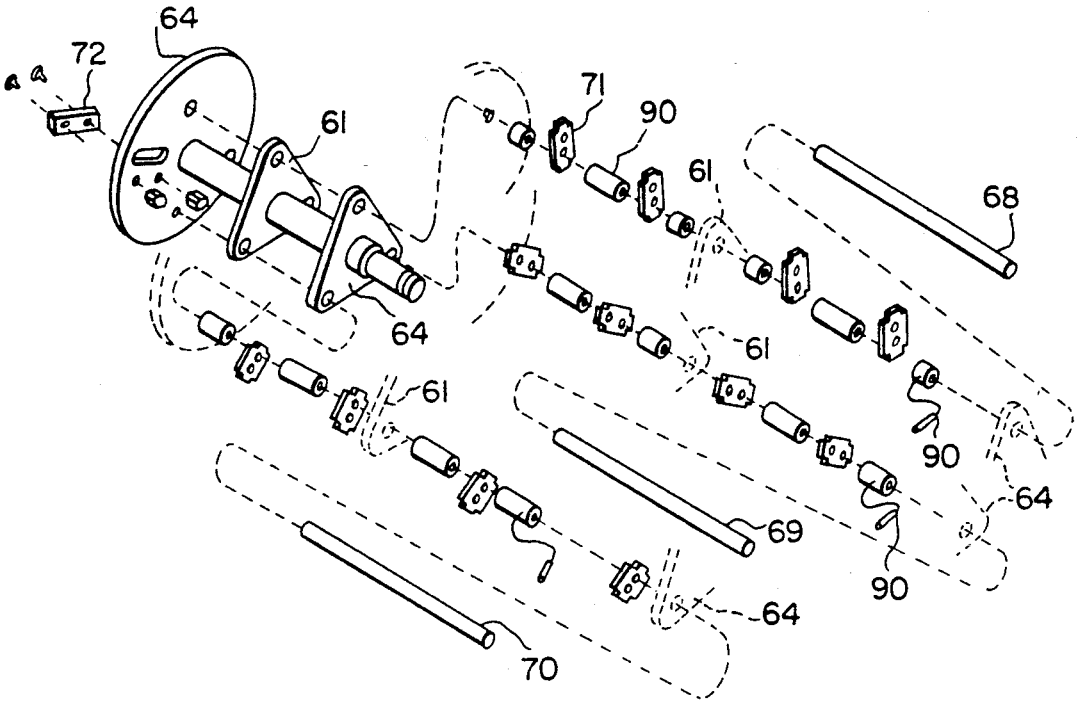
FIG. 8 is an exploded view of typical piece parts used in the flail assembly of this invention.

Reference to FIG. 8, the exploded perspective view, and to FIG. 6 illustrates the detail of flail mounting and the use of spacers 90 to arrange the flails 71 on each carrier 68, 69 and 70 so that each tip end 71*a* of each flail 71 traces a path that is axially offset from the path of each other flail tip end. Clearly the arrangement of flails and their spacing on each carrier is largely controlled by the collar spacers and hence provides the designer with great flexibility without destroying the static and dynamic balance.

Figure 9:
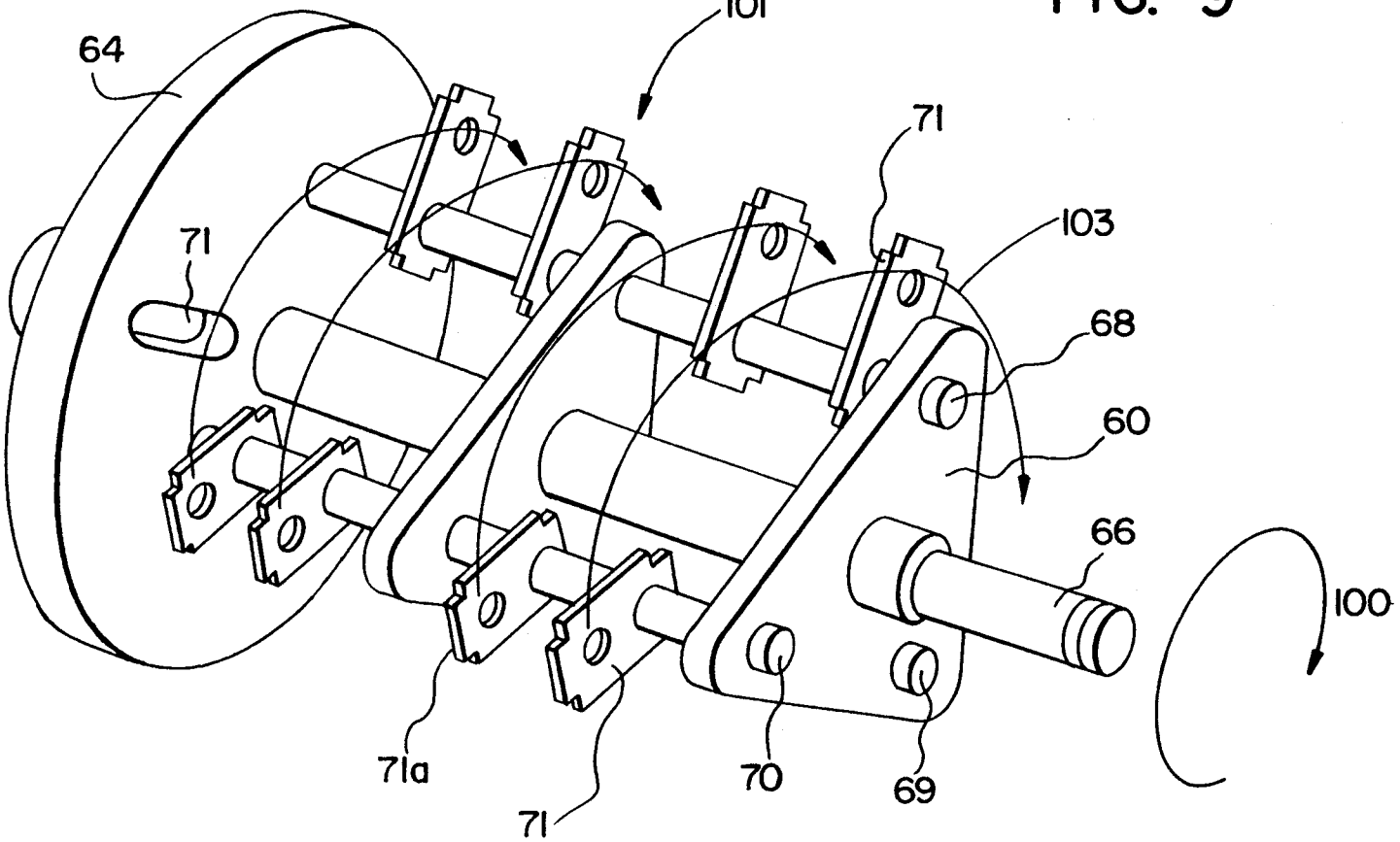
FIG. 9 is a partial perspective view of the flail assembly of this invention showing the generally helical tip configuration which can be used to promote material feeding.

An additional advantage obtained from the present invention (which utilizes discretely different flail spacing on each flail carrier) is best illustrated in FIG. 9 wherein flails 71 comprising a flail assembly that is rotated in the direction of arrow 100 such that material approaching the flails 71 along the arrow 101 experiences a flail tip pattern that is helical in nature as shown by the arrow 103 thereby urging material in a desired direction tending to further minimize the opportunity for material jamming while at the same time increasing material through-put.

The flail assembly of the present invention provides the advantage of using only three point to determine the plane of support for the carriers thereby simplifying formation of that carrier support and permitting a more easily balanced final assembly. Moreover, the triangular shaped supports plates are smaller and lighter than the comparable square plates of the prior art and the number of flails and their requisite support structure is reduced in mass thereby significantly reducing the mass of the rotating device and enhancing its ability to be dynamically balanced.

The choice of feed direction as illustrated in FIG. 9 is determined by the positioning of the flail assembly by the collars and the direction of rotation such that incoming material can be urged away from the chipper disc (clockwise spiral as viewed from the chipper end), it can be urged toward the chipper disc (counterclockwise spiral as viewed from the chipper end), it can be urged away from the center of the shredder chamber by having oppositely directed spirals and it can be directed towards the center of the shredder chamber by having the spirals urge the material towards the center; such advantages are determined by the orientation of the flails, the spacing of the flails and the direction of rotation of the assembly. Such considerations are however, primarily design considerations because the commercial product is generally a unidirectional rotating product and such features will be determined by factory design.

It is therefore seen that a shredder assembly having lower mass than that found in the prior art has been devised while presenting fewer parts to be dynamically balanced; when comparing a four support shredder assembly with the three support assembly of the present invention, fewer flails are used to present more cutting surfaces.

As will be apparent to persons skilled in the art, various modifications, adaptations and variations of the foregoing specific disclosure can be made without departing from the teachings of this invention.

I claim:

1. A rotatably driven shredding mechanism for use in apparatus for chipping/shredding branches and the like comprising a frame having a central axis about which the frame is rotatably supported and driven, said frame including at least two axially spaced disc-shaped supports mounted thereon for rotation therewith, a plurality of carriers extending between and secured to said disc-shaped supports at a radius from the axis of rotation, each carrier pivotably supporting a plurality of flails, the axial spacing between flails on one of said carriers being different from the axial spacing between flails on each other carrier, each of said flails being pivotable without interference with any other flail, one of said disc-shaped supports being a chipper disc and the other of said disc supports having a generally triangular profile, said plurality of carriers being three in number extending from and fixedly supported between said chipper disc and the region of the apex of the triangularly shaped other of said discs, and wherein a line extending from the flail tip adjacent the chipper disc through each flail tip to the outermost flail tip adjacent the second disc-shaped triangular support is generally a helix such that, upon rotation of the frame, materials inserted into the shredding mechanism are urged toward one axial end of the frame, said frame and connected structure being statically and dynamically balanced about the central axis.

2. An apparatus for shredding branches, limbs, twigs, leaves and the like material, said apparatus including a housing forming a shredding cavity, a passageway through which material to be shredded enters the cavity, a shredding mechanism having a central axis, means rotatably supporting and selectively driving said shredding mechanism in said shredding cavity, said mechanism having a frame including at least two axially spaced disc-shaped supports mounted thereon for rotation therewith, each carrier pivotably supporting a plurality of flails, the axial spacing between flails on one of said carriers being different from the axial spacing between flails on each other carrier, each of said flails being pivotable without interference with any other flail, whereby, upon rotation of said frame, the tip end of said flail traces a path that is axially offset from the path of each other flail tip end, said frame includes as one of said disc-shaped supports a chipper disc and another of said disc-shaped supports has a generally triangular profile and three carriers extend from and are fixedly supported between said chipper disc and the region of the apex of the triangularly shaped disc, wherein a line extending from the flail tip adjacent the chipper disc through each flail tip to the outermost flail tip adjacent the second disc-shaped triangular support is generally a helix such that, upon rotation of the frame, materials inserted into the shredding mechanism is urged toward one axial end of the frame.

* * * * *